US008622498B2

(12) United States Patent
Ozawa

(10) Patent No.: US 8,622,498 B2
(45) Date of Patent: Jan. 7, 2014

(54) LIQUID EJECTING APPARATUS AND LIQUID EJECTING METHOD

(75) Inventor: Kinya Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 572 days.

(21) Appl. No.: 12/611,747

(22) Filed: Nov. 3, 2009

(65) Prior Publication Data

US 2010/0110128 A1 May 6, 2010

(30) Foreign Application Priority Data

Nov. 5, 2008 (JP) ..... 2008-284631

(51) Int. Cl.
*B41J 29/38* (2006.01)

(52) U.S. Cl.
USPC ..... 347/10; 347/5; 347/6; 347/9; 347/11; 347/14; 347/68

(58) Field of Classification Search
USPC ..... 347/5–6, 9–11, 14, 68
See application file for complete search history.

(56) References Cited

U.S. PATENT DOCUMENTS

| | | | | |
|---|---|---|---|---|
| 5,502,467 | A * | 3/1996 | Hoisington et al. | 347/6 |
| 6,540,338 | B2 | 4/2003 | Takahashi et al. | |
| 6,761,423 | B2 * | 7/2004 | Ozaki et al. | 347/11 |
| 7,374,263 | B2 | 5/2008 | Hosono | |
| 7,513,041 | B2 | 4/2009 | Ito et al. | |
| 2006/0187262 | A1 | 8/2006 | Ito | |
| 2006/0221106 | A1 * | 10/2006 | Mataki | 347/10 |
| 2007/0091148 | A1 * | 4/2007 | Onozawa | 347/67 |
| 2008/0106558 | A1 * | 5/2008 | Azami | 347/11 |
| 2008/0204538 | A1 * | 8/2008 | Kovacs et al. | 347/102 |
| 2008/0218570 | A1 * | 9/2008 | Kovacs et al. | 347/88 |
| 2009/0244200 | A1 * | 10/2009 | Ozawa | 347/68 |
| 2010/0110128 | A1 * | 5/2010 | Ozawa | 347/10 |

FOREIGN PATENT DOCUMENTS

| | | | | |
|---|---|---|---|---|
| JP | 07-144409 A | | 6/1995 | |
| JP | 07-178899 A | | 7/1995 | |
| JP | 2002-001965 A | | 1/2002 | |
| JP | 2002-113860 A | | 4/2002 | |
| JP | 2002-001965 | * | 8/2002 | B41J 2/135 |
| JP | 2003-237067 A | | 8/2003 | |
| JP | 2004-090223 A | | 3/2004 | |
| JP | 2005-103984 A | | 4/2005 | |
| JP | 2006-212920 A | | 8/2006 | |
| JP | 2006-224619 A | | 8/2006 | |
| JP | 2007-050672 A | | 3/2007 | |
| JP | 2007-183319 A | | 7/2007 | |

* cited by examiner

*Primary Examiner* — Ryan Lepisto
*Assistant Examiner* — Guy Anderson
(74) *Attorney, Agent, or Firm* — Kilpatrick Townsend & Stockton LLP

(57) ABSTRACT

A liquid ejecting apparatus includes: a pressure chamber that communicates with a liquid supply section and a nozzle; an element that changes a pressure of liquid within the pressure chamber; and an ejection pulse generation section that generates an ejection pulse for operating the element in order to eject the liquid from the nozzle. In the apparatus, the viscosity of the liquid is not less than 8 millipascal seconds. The nozzle has a first portion in which a liquid ejection side thereof has a smaller opening area than a pressure chamber side thereof, and a second portion which communicates with an ejection side end portion of the first portion. In addition, the ejection pulse has a depressurizing portion for depressurizing the liquid in order to attract a meniscus positioned on the second portion to the first portion, and a pressurizing portion for pressurizing the liquid in order to eject the liquid before the meniscus attracted to the first portion returns to the second portion.

5 Claims, 13 Drawing Sheets

FIG. 18

| ANGLE / VISCOSITY | 20 | 25 | 30 | 40 |
|---|---|---|---|---|
| 8 mPas | △(TAIL IS LONG) | △(TAIL IS LONG) | △(TAIL IS LONG) | ○ |
| 10 mPas | △(TAIL IS LONG) | △(TAIL IS LONG) | △(TAIL IS LONG) | ○ |
| 15 mPas | △(TAIL IS LONG) | △(TAIL IS LONG) | △(TAIL IS LONG) | ○ |
| 20 mPas | ×(DISALLOWANCE) | △(TAIL IS LONG) | △(TAIL IS LONG) | △(TAIL IS LONG) |
| 30 mPas | ×(DISALLOWANCE) | ×(DISALLOWANCE) | ×(DISALLOWANCE) | △(TAIL IS LONG) |
| 40 mPas | ×(DISALLOWANCE) | ×(DISALLOWANCE) | ×(DISALLOWANCE) | ×(DISALLOWANCE) |

| ANGLE / VISCOSITY | 50 | 60 | 80 |
|---|---|---|---|
| 8 mPas | ○ | ○ | ○ |
| 10 mPas | ○ | ○ | ○ |
| 15 mPas | ○ | ○ | ○ |
| 20 mPas | ○ | ○ | ○ |
| 30 mPas | ○ | ○ | ○ |
| 40 mPas | ×(DISALLOWANCE) | ×(DISALLOWANCE) | △(TAIL IS LONG) |

FIG. 19

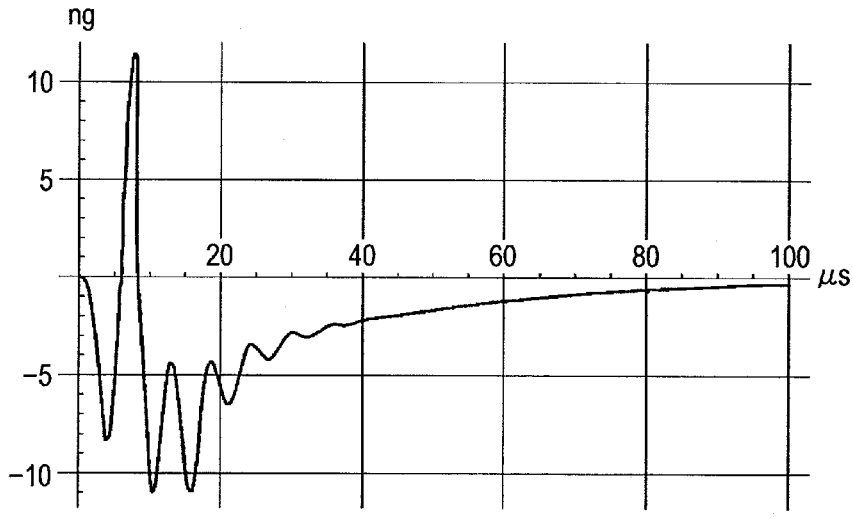

LIQUID EJECTING APPARATUS AND LIQUID EJECTING METHOD

This application claims priority to Japanese Patent Application No. 2008-284631, filed Nov. 5, 2008, the entirety of which is incorporated by reference herein.

BACKGROUND

1. Technical Field

The present invention relates to a liquid ejecting apparatus and a liquid ejecting method.

2. Related Art

Recently, an inkjet printer technique has been applied to eject a liquid (it is referred to as a high viscosity liquid) having a viscosity higher than that of the water-based ink which is usually used. For example, there has been proposed an apparatus in which a nozzle for ejecting liquid includes a taper portion tapering off toward the ink ejection side and a straight portion disposed successively from the tip of the ejection side of the taper portion (for example, refer to Japanese Unexamined Patent Application Publication No. 2004-90223).

When the high viscosity liquid is ejected from the nozzle including the taper portion and the straight portion, sometimes the ejection of the liquid becomes unstable. For example, the liquid may not be ejected, and an ejection amount may be insufficient. Various factors can be considered which make the ejection unstable. One of the factors is that a pressure of the liquid within the pressure chamber is not efficiently applied to eject the liquid.

SUMMARY

An advantage of some aspects of the invention is to efficiently eject the high viscosity liquid.

According to an aspect of the invention, a liquid ejecting apparatus includes: a pressure chamber that communicates with a liquid supply section and a nozzle; an element that changes a pressure of liquid within the pressure chamber; and an ejection pulse generation section that generates an ejection pulse for operating the element in order to eject the liquid from the nozzle. In the apparatus, the viscosity of the liquid is not less than 8 millipascal seconds. The nozzle has a first portion in which a liquid ejection side thereof has a smaller opening area than a pressure chamber side thereof, and a second portion which communicates with an ejection side end portion of the first portion. In addition, the ejection pulse has a depressurizing portion for depressurizing the liquid in order to attract a meniscus positioned on the second portion to the first portion, and a pressurizing portion for pressurizing the liquid in order to eject the liquid before the meniscus attracted to the first portion returns to the second portion.

The other characteristics of the invention will be described in the following embodiments and the accompanying drawings.

BRIEF DESCRIPTION OF THE DRAWINGS

The invention will be described with reference to the accompanying drawings, wherein like numbers reference like elements.

FIG. 4 is a block diagram illustrating a configuration of a driving signal generation circuit and the like.

FIG. 18 is a diagram illustrating a list of evaluation results of taper angles.

FIG. 19 is a diagram illustrating simulation data for explaining a case where the ejection becomes stable depending on the impedance ratio of the nozzle to the ink supply passage.

DESCRIPTION OF EXEMPLARY EMBODIMENTS

Figure 1:
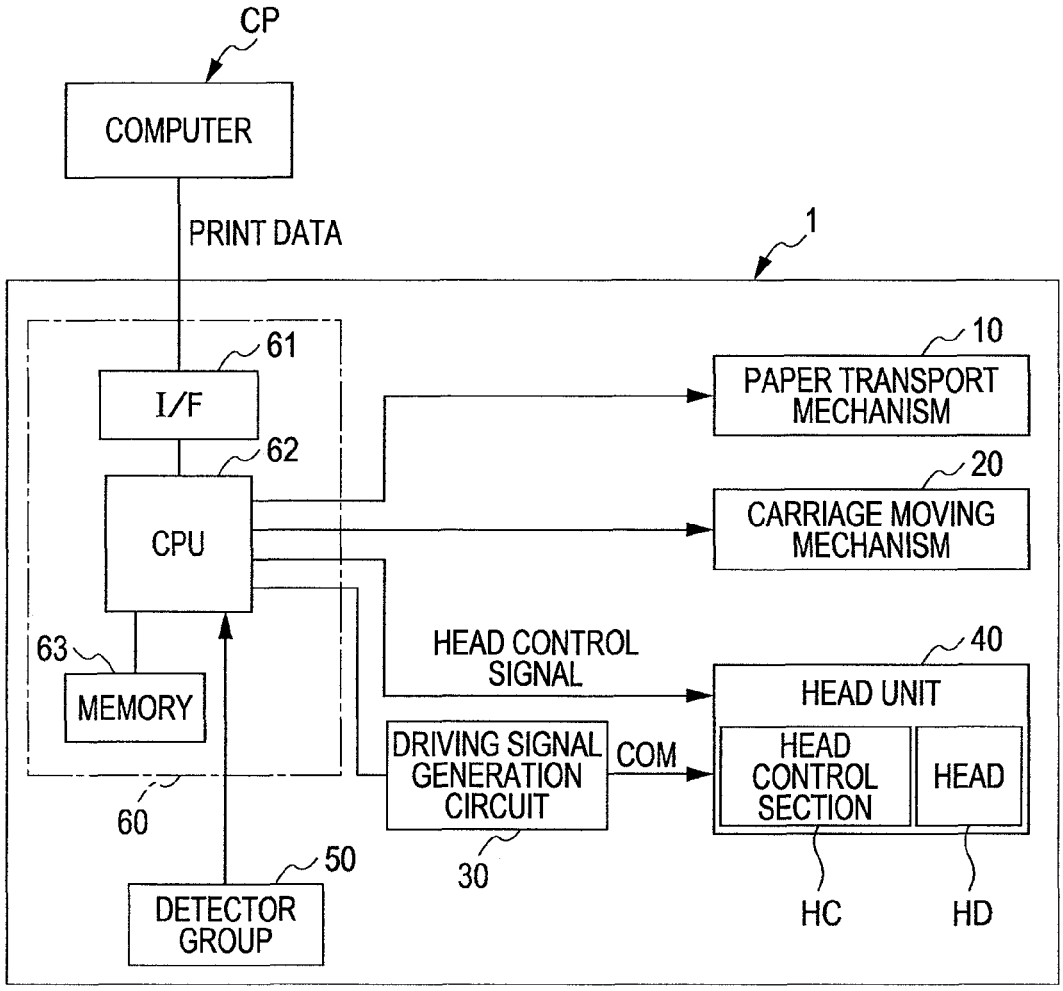
FIG. 1 is a block diagram illustrating a configuration of a printing system.

Hereinafter, embodiments of the invention will be described with reference to the accompanying drawings.

Specifically, there is provided a liquid ejecting apparatus including: a pressure chamber that communicates with a liquid supply section and a nozzle; an element that changes a pressure of liquid within the pressure chamber; and an ejection pulse generation section that generates an ejection pulse for operating the element in order to eject the liquid from the nozzle. In the apparatus, the viscosity of the liquid is not less than 8 millipascal seconds. The nozzle has a first portion in which a liquid ejection side thereof has a smaller opening area than a pressure chamber side thereof, and a second portion which communicates with an ejection side end portion of the first portion. In addition, the ejection pulse has a depressurizing portion for depressurizing the liquid in order to attract a meniscus positioned on the second portion to the first portion, and a pressurizing portion for pressurizing the liquid in order to eject the liquid before the meniscus attracted to the first portion returns to the second portion.

According to the liquid ejecting apparatus, when the element is operated by the pressurizing portion, a pressure at a local portion closer to the second portion in the first portion increases. Thereby, it is possible to efficiently use the pressure applied to the liquid for ejection of the liquid, and thus it is also possible to efficiently eject a high viscosity liquid.

In the liquid ejecting apparatus according to the embodiment, it is preferred that the ejection pulse have a maintaining portion for maintaining a state of the element at the time of stopping the generation of the depressurizing portion during the time period from the time of stopping generation of the depressurizing portion to the time of starting the application of the pressurizing portion.

According to the liquid ejecting apparatus, it is possible to determine the timing of the start of the pressurization caused by the pressurizing portion by determining the time period of forming the maintaining portion. Hence, it is possible to optimize the timing.

In the liquid ejecting apparatus according to the embodiment, it is preferred that an impedance of the nozzle be smaller than an impedance of the liquid supply section.

According to the liquid ejecting apparatus, it is possible to efficiently transfer pressure oscillation, which is generated in the liquid within the pressure chamber, to the nozzle. Therefore, it is possible to efficiently eject the high viscosity liquid.

In the liquid ejecting apparatus according to the embodiment, it is preferred that the first portion of the nozzle should partition a space formed in a circular truncated cone shape having a taper angle of 40 degrees or more.

According to the liquid ejecting apparatus, it is possible to prevent the tailing portions of ink droplets from excessively elongating. Furthermore, the angle of 40 degrees does not mean a precise angle, but may have some variation.

In the liquid ejecting apparatus according to the embodiment, it is preferred that the first portion of the nozzle be set to have a taper angle within a range depending on the viscosity of the liquid.

According to the liquid ejecting apparatus, it is possible to prevent the tailing portions of the liquid droplets from excessively elongating.

In the liquid ejecting apparatus according to the embodiment, it is preferred that the second portion of the nozzle be formed in a shape of which a sectional area scarcely changes on a plane orthogonal to a nozzle direction.

According to the liquid ejecting apparatus, it is possible to stabilize the flying directions of the ejected liquid droplets.

In the liquid ejecting apparatus according to the embodiment, it is preferred that a length of the second portion of the nozzle in the ejection direction be smaller than an inner diameter of an opening portion.

According to the liquid ejecting apparatus, it is possible to efficiently transfer pressure oscillation, which is generated in the liquid within the pressure chamber, to the nozzle.

In the liquid ejecting apparatus according to the embodiment, it is preferred that the second portion of the nozzle should partition a space formed in a different circular truncated cone shape which has a smaller taper angle than the first portion.

According to the liquid ejecting apparatus, it is possible to increase a flying speed of the liquid droplets.

In the liquid ejecting apparatus according to the embodiment, it is preferred that the element be a piezoelectric element which is deformed in accordance with an electric potential of the applied ejection pulse so as to change a volume of the pressure chamber and thereby change the pressure of the liquid.

According to the liquid ejecting apparatus, it is possible to minutely control the pressure applied to the liquid.

In the liquid ejecting apparatus according to the embodiment, it is preferred that the ejection pulse be set to allow a volume variation of the pressure chamber per unit time caused by the pressurizing portion to be larger than a volume variation of the pressure chamber per unit time caused by the depressurizing portion, and that there is no section, which is subsequent to the pressurizing portion, for suppressing movement of the meniscus after the ejection of the liquid.

According to the liquid ejecting apparatus, it is possible to apply a stronger pressure by the liquid in the first portion. Further, it is also appropriate for high-frequency ejection of the liquid droplets.

Further, there is provided a liquid ejecting method for ejecting the liquid, of which the viscosity is 8 millipascal seconds or more, from the nozzle by using a liquid ejecting apparatus. The apparatus includes a pressure chamber, which communicates with a liquid supply section, a nozzle, which communicates with the pressure chamber and has a first portion in which a liquid ejection side thereof has a smaller opening area than a pressure chamber side thereof and a second portion which communicates with an ejection side end portion of the first portion, and an element, which changes a pressure of liquid within the pressure chamber. The liquid ejecting method includes: depressurizing the liquid in order to attract a meniscus positioned on the second portion to the first portion; and pressurizing the liquid in order to eject the liquid before the meniscus attracted to the first portion returns to the second portion.

First Embodiment

Regarding Printing System

The printing system exemplified in FIG. 1 includes a printer 1 and computer CP. The printer 1 corresponds to a liquid ejecting apparatus, and ejects an ink as a liquid toward a medium such as a paper, a cloth, and a film. The medium is a target object which is a target of the liquid ejection. The computer CP is connected so as to be able to communicate with the printer 1. In order to make the printer 1 print an image, the computer CP transmits print data based on the image to the printer 1.

Outline of Printer 1

The printer 1 includes a paper transport mechanism 10, a carriage moving mechanism 20, a driving signal generation circuit 30, a head unit 40, a detector group 50, and a printer controller 60.

The paper transport mechanism 10 transports a paper in a transport direction. The carriage moving mechanism 20 moves a carriage, on which the head unit 40 is mounted, in a predetermined moving direction (for example, a widthwise direction of the paper). The driving signal generation circuit 30 generates a driving signal COM. The driving signal COM is transmitted to a head HD (piezoelectric elements 433, refer to FIG. 2) at the time of the printing of the paper, and includes an ejection pulse PS as exemplified in FIG. 5. Here, the ejection pulse PS is a potential variation pattern which allows the piezoelectric elements 433 to perform a predetermined operation so as to eject the ink having a droplet shape from the head HD (nozzles 427). Since the driving signal COM includes the ejection pulse PS, the driving signal generation circuit 30 corresponds to an ejection pulse generation section. Furthermore, a configuration of the driving signal generation circuit 30 or the ejection pulse PS will be described later. The head unit 40 has the head HD and a head control section HC. The head HD ejects an ink in a liquid state toward the paper, and corresponds to a liquid ejecting head. The head control section HC controls the head HD on the basis of a head control signal received from the printer controller 60. Furthermore, the head HD will be described later. The detector group 50 is formed of a plurality of detectors for monitoring a situation of the printer 1. Detection results obtained by those detectors are output to the printer controller 60. The printer controller 60 controls the overall system of the printer 1. The printer controller 60 also will be described later.

Main Parts of Printer 1

Regarding Head HD

Figure 2:
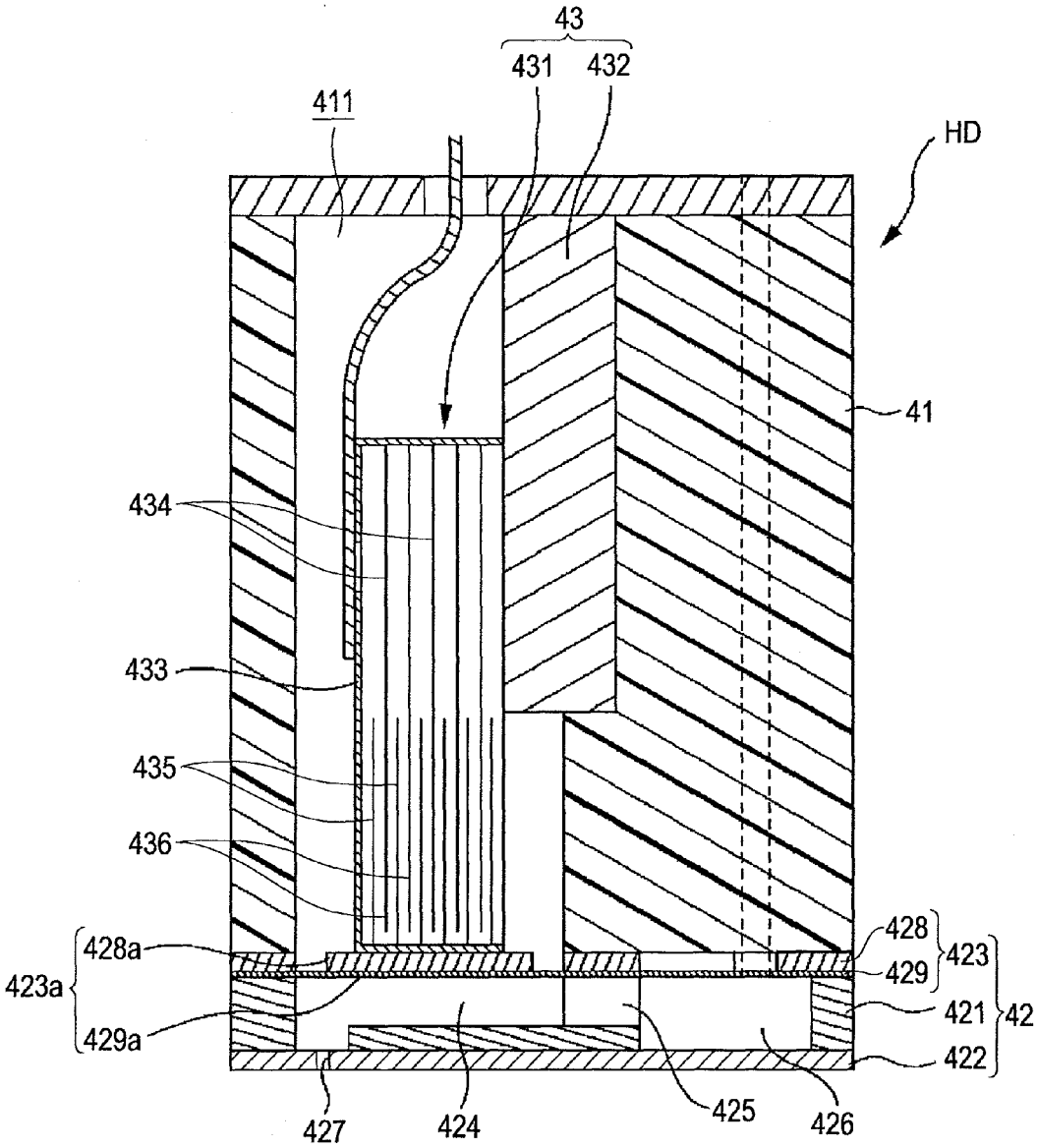
FIG. 2 is a sectional view of a head.

As shown in FIG. 2, the head HD includes a casing 41, a flow passage unit 42, and a piezoelectric element unit 43. The casing 41 is provided with a containing room 411 thereof for containing and fixing the piezoelectric element unit 43. The casing 41 is made of, for example, a resin material. In addition, a flow passage unit 42 is bonded to the leading end surface of the casing 41.

The flow passage unit 42 has a flow passage formation substrate 421, a nozzle plate 422, and a vibrating plate 423. In addition, the nozzle plate 422 is bonded to one surface of the flow passage formation substrate 421, and the vibrating plate 423 is bonded to the other surface thereof. The flow passage formation substrate 421 is provided with pressure chambers 424, an ink supply passage 425, a common ink chamber 426, and the like. The flow passage formation substrate 421 is formed by, for example, a silicon substrate. Each pressure chamber 424 is formed as a room having a thin and long shape in a direction orthogonal to an arrangement direction of the nozzles 427. The ink supply passage 425 is a portion of a narrow flow passage for interconnecting the pressure chamber 424 and the common ink chamber 426. The ink supply passage 425 corresponds to a liquid supply section for supplying the liquid to the pressure chamber 424. The common ink chamber 426 is a portion for temporarily storing the ink supplied from an ink cartridge (not shown in the drawing), and corresponds to a common liquid reservoir.

The nozzle plate 422 is provided with the plurality of nozzles 427 which are arranged at a predetermined interval in a predetermined arrangement direction. The nozzle plate 422 is formed by, for example, a stainless plate or a silicon substrate. Furthermore, the nozzles 427 provided on the nozzle plate 422 will be described later in detail.

The vibrating plate 423 has a double layer structure in which an elastic film 429 made of resin is laminated on a supporting plate 428 made of stainless steel. In a portion of the vibrating plate 423 corresponding to each pressure chamber 424, the portion of the stainless steel plate is etched in a ring shape. In addition, an insular portion 428*a* is formed in the ring. The insular portion 428*a* and the elastic film 429*a* around the insular portion 428*a* constitute a diaphragm section 423*a*. The diaphragm section 423*a* is deformed by the piezoelectric element 433 included in the piezoelectric element unit 43, and changes a volume of the pressure chamber 424.

The piezoelectric element unit 43 has a piezoelectric element group 431 and a fixation plate 432. The piezoelectric element group 431 has a comb-teeth-like shape. In addition, each one of the teeth is the piezoelectric element 433. The leading end surface of each piezoelectric element 433 is bonded to the corresponding insular portion 428*a*. The fixation plate 432 supports the piezoelectric element group 431, and is formed as a mounting portion for the casing 41. The fixation plate 432 is constituted by, for example, a stainless steel plate, and is bonded to an inside wall of the containing room 411.

The piezoelectric element 433 is an electromechanical transducing element, and corresponds to an element which performs an operation (a deformation operation) for changing a pressure of the liquid within the pressure chamber 424. The piezoelectric element 433 shown in FIG. 2 expands and contracts in the lengthwise direction of the element orthogonal to a lamination direction by applying a potential difference between electrodes adjacent to each other. Specifically, the electrodes include a common electrode 434 having a predetermined electric potential and a drive electrode 435 having an electric potential depending on the driving signal COM (the ejection pulse PS). In addition, a piezoelectric substance 436 interposed between both electrodes 434 and 435 is deformed in accordance with a potential difference between the common electrode 434 and the drive electrode 435. The piezoelectric element 433 expands and contracts in the lengthwise direction of the element in accordance with the deformation of the piezoelectric substance 436. The electric potential of the common electrode 434 is set to a ground potential or a bias electric potential higher by a predetermined electric potential than the ground potential. In addition, the piezoelectric element 433 contracts as the electric potential of the drive electrode 435 becomes higher than the electric potential of the common electrode 434. In contrast, the piezoelectric element 433 expands as the electric potential of the drive electrode 435 becomes closer to the electric potential of the common electrode 434 or becomes lower than the electric potential of the common electrode 434.

As described above, the piezoelectric element unit 43 is mounted on the casing 41 with the fixation plate 432 interposed therebetween. Hence, when the piezoelectric element 433 contracts, the diaphragm section 423*a* is attracted in a separating direction from the pressure chamber 424. Thereby, the pressure chamber 424 expands. In contrast, when the piezoelectric element 433 expands, the diaphragm section 423*a* is pressed toward the pressure chamber 424. Thereby, the pressure chamber 424 contracts. A pressure of the ink within the pressure chamber 424 is changed by the expansion and the contraction of the pressure chamber 424. Specifically, the ink within the pressure chamber 424 is pressurized by the contraction of the pressure chamber 424, and the ink within the pressure chamber 424 is depressurized by the expansion of the pressure chamber 424. Since the expansion and contraction states of the piezoelectric element 433 are determined by the electric potential of the drive electrode 435, the volume of the pressure chamber 424 is also determined by the electric potential of the drive electrode 435. Accordingly, a degree of pressurization and a degree of depressurization applied to the ink within the pressure chamber 424 can be determined by a potential variation of the drive electrode 435 per unit time.

Regarding Ink Flow Passage

Figure 3:
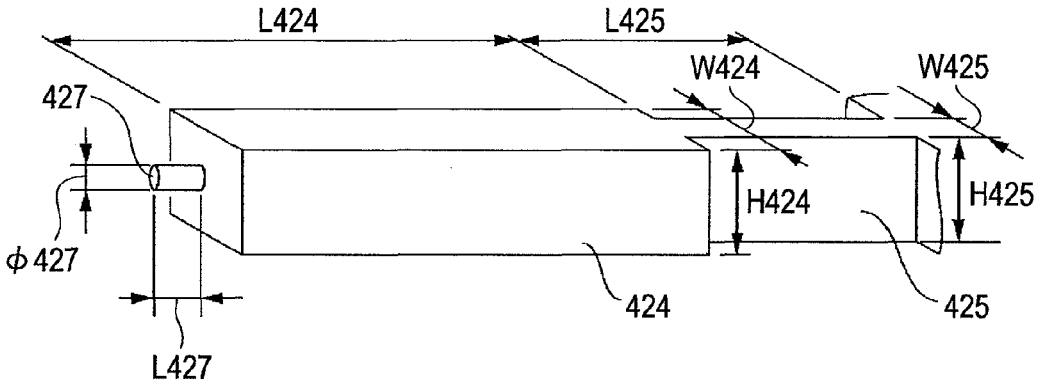
FIG. 3 is a view schematically illustrating a structure of the head.

The head HD is provided with a plurality of ink flow passages (which corresponds to liquid flow passages filled with the liquid), which extend from the common ink chamber 426 to the nozzles 427, according to the number of the nozzles 427. In each ink flow passage, the nozzle 427 and the ink supply passage 425 are connected to the pressure chamber 424. Hence, in order to analyze characteristics such as ink flow, a Helmholtz resonator concept is applied. FIG. 3 is a diagram schematically illustrating a structure of the head HD based on the concept.

In the general head HD, a length L424 of the pressure chamber 424 is determined within the range from 200 μm to 2000 μm. A width W424 of the pressure chamber 424 is determined within the range from 20 μm to 300 μm, and a height H424 of the pressure chamber 424 is determined within the range of 30 μm to 500 m. In addition, a length L425 of the ink supply passage 425 is determined within the range of 50 μm to 2000 μm. A width W425 of the ink supply passage 425 is determined within the range of 20 μm to 300 μm, and a height H425 of the ink supply passage 425 is determined within the range of 30 μm to 500 μm. In addition, a diameter ϕ427 of the nozzle 427 is determined within the range of 10 μm to 35 μm, and a length L427 of the nozzle 427 is determined within the range of 40 μm to 100 μm.

In addition, the width W425 and the height H425 of the ink supply passage 425 are determined to be not more than the width W424 and the height H424 of the pressure chamber 424. In addition, when one side of the width W425 or the height H425 of the ink supply passage 425 is adjusted to one side of the width W424 or the height H424 of the pressure chamber 424, the other side of the width W425 or the height H425 of the ink supply passage 425 is determined to be less than the other side of the width W424 or the height H424 of the pressure chamber 424.

In such an ink flow passage, the ink is ejected from the nozzle 427 by changing a pressure of the ink within the pressure chamber 424. At this time, the pressure chamber 424, the ink supply passage 425, and the nozzle 427 function as a Helmholtz resonator. Hence, a magnitude of the pressure applied to the ink within the pressure chamber 424 changes in accordance with a unique period which is called a Helmholtz period. Specifically, pressure oscillation occurs in the ink. The Helmholtz period is also called a natural oscillation period of the ink (liquid) in the pressure chamber 424. A meniscus (a free surface of the ink exposed in the nozzle 427) is periodically moved in the nozzle 427 by the pressure oscillation of the Helmholtz period. In addition, by using the pressure change of the Helmholtz period, it is possible to efficiently eject the ink from the nozzle 427.

In the general head HD, the Helmholtz period is determined within the range of 5 μs to 10 μs. For example, in the ink flow passage shown in FIG. 3, the width W424 of the pressure chamber 424 is set to 100 μm, the height H424 thereof is set to 70 μm, the length L424 thereof is set to 1000 μm, the width W425 of the ink supply passage 425 is set to 50 μm, the height H425 thereof is set to 70 m, the length L425 thereof is set to 500 μm, the diameter ϕ427 of the nozzle 427 is set to 30 μm, and the length L427 is set to 100 μm. In this case, the Helmholtz period is about 8 μs. Furthermore, the Helmholtz period also changes depending on the thicknesses of partition walls for partitioning the pressure chambers 424, a thickness and a compliance of the elastic film 429, and materials of the flow passage formation substrate 421 and the nozzle plate 422.

Regarding Printer Controller 60

The printer controller 60 controls the overall system of the printer 1. For example, the printer controller 60 controls a control target section on the basis of print data received from the computer CP and the detection results obtained from the detectors, thereby printing an image on a paper. As shown in FIG. 1, the printer controller 60 has an interface section 61, a CPU 62, and a memory 63. The interface section 61 exchanges data with the computer CP. The CPU 62 controls the overall system of the printer 1. The memory 63 secures a region for storing the computer program, a work region, and the like. The CPU 62 controls the control target sections in accordance with the computer program stored in the memory 63. For example, the CPU 62 controls the paper transport mechanism 10 and the carriage moving mechanism 20. In addition, the CPU 62 transmits a head control signal for controlling the operation of the head HD to the head control section HC, or transmits a control signal for generating a driving signal COM to the driving signal generation circuit 30.

Here, the control signal for generating the driving signal COM is also called DAC data, and for example, the signal is digital data of a plurality of bits. The DAC data determines a potential variation pattern of the generated driving signal COM. Accordingly, the DAC data also can be defined as data representing an electric potential of the ejection pulse PS or the driving signal COM. The DAC data is stored in a predetermined region of the memory 63, and the DAC data is read out at the time of generating the driving signal COM and is output to the driving signal generation circuit 30.

Regarding Driving Signal Generation Circuit 30

Figure 4:
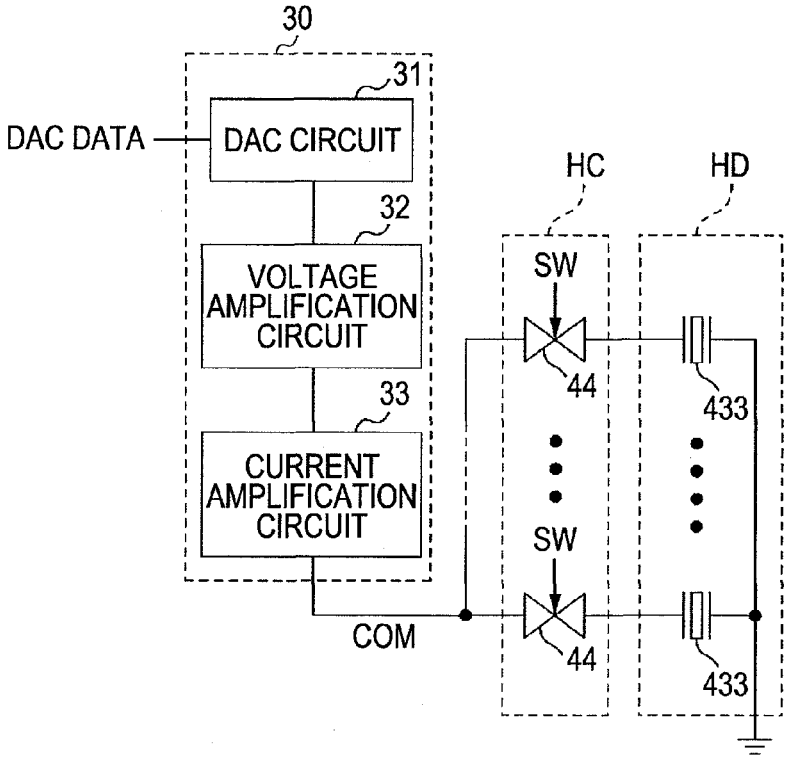

The driving signal generation circuit 30 functions as the ejection pulse generation section and generates the driving signal COM containing the ejection pulse PS on the basis of the DAC data. As shown in FIG. 4, the driving signal generation circuit 30 has a DAC circuit 31, a voltage amplification circuit 32, and a current amplification circuit 33. The DAC circuit 31 converts the digital DAC data into the analog signal. The voltage amplification circuit 32 amplifies a voltage of the analog signal converted by the DAC circuit 31 to a level capable of driving the piezoelectric element 433. In the printer 1, the analog signal, which is output from the DAC circuit 31, is maximum 3.3 V, while the amplified analog signal (which is also referred to as a waveform signal for convenience), which is output from the voltage amplification circuit 32, is maximum 42 V. The current amplification circuit 33 amplifies a current of the waveform signal output from the voltage amplification circuit 32, and outputs the signal as the driving signal COM. The current amplification circuit 33 is formed by, for example, a pair of transistors connected in push-pull configuration.

Regarding Head Control Section HC

The head control section HC selects necessary portions of the driving signal COM, which is generated by the driving signal generation circuit 30, on the basis of the head control signal, and applies the selected portions thereof to the piezoelectric element 433. Hence, as shown in FIG. 4, the head control section HC has a plurality of switches 44 which are respectively provided on the piezoelectric elements 433 in the course of the supply line of the driving signal COM. Then, the head control section HC generates a switch control signal from the head control signal. By controlling the switches 44 on the basis of the switch control signal, the necessary portions (for example, the ejection pulse PS) of the driving signal COM are applied to the piezoelectric elements 433.

Regarding Driving Signal COM

Figure 5:
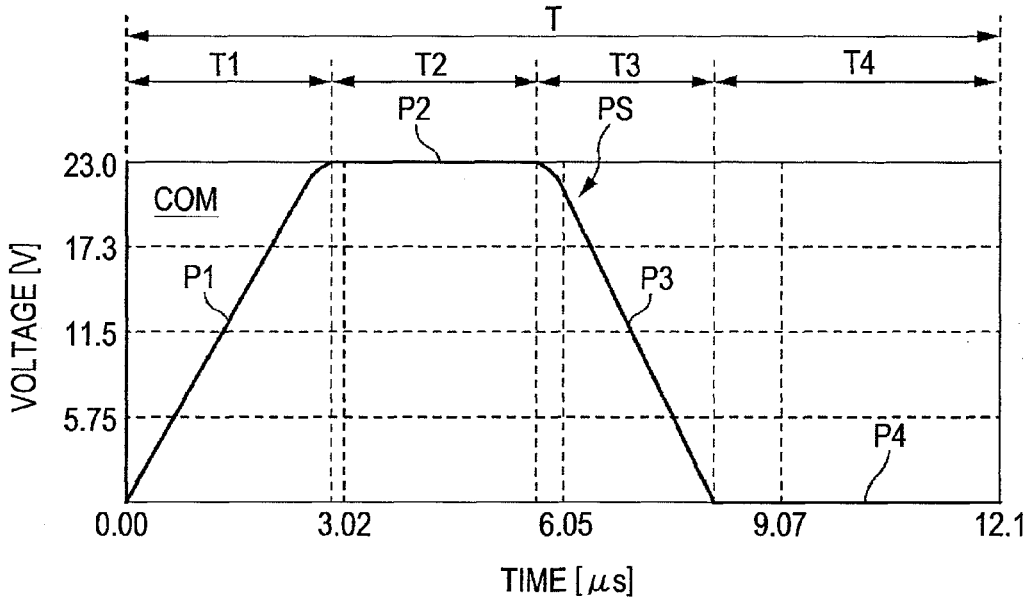
FIG. 5 is a diagram illustrating an example of a driving signal.

Next, the driving signal COM, which is generated by the driving signal generation circuit 30, will be described. FIG. 5 is a diagram illustrating the driving signal COM, wherein the vertical axis thereof represents a voltage of the driving signal COM, and the horizontal axis thereof represents time. Furthermore, in the embodiment, the driving signal generation circuit 30 generates the driving signal COM having a voltage based on the ground potential, and the common electrode 434 of the piezoelectric elements 433 is set to the ground potential. Hence, the voltage of the driving signal COM represents the electric potential of the drive electrode 435 determined by the driving signal COM.

As shown in the drawing, the driving signal COM includes the ejection pulse PS. The driving signal COM is applied to the drive electrode 435. Thereby, potential difference is caused by the waveform (which corresponds to the potential variation pattern) of the ejection pulse PS between the drive electrode 435 and the common electrode 434 of which the potential is fixed. As a result, the piezoelectric element 433 expands and contracts in accordance with the waveform, thereby varying a volume of the pressure chamber 424.

The ejection pulse PS is constituted by so-called trapezoidal waves. When the ejection pulse PS having these trapezoidal waves is applied to the piezoelectric element 433 (specifically, the drive electrode 435), the pressure chamber 424 expands in the range from the minimum volume corresponding to the minimum potential thereof to the maximum volume corresponding to the maximum potential thereof. Then, the pressure chamber 424 contracts again to the minimum volume. Then, when the pressure chamber 424 contracts from the maximum volume to the minimum volume, the ink within the pressure chamber 424 is pressurized, thereby ejecting the ink (ink droplets) having a droplet shape from the nozzle 427.

In the ejection pulse PS exemplified in FIG. 5, a portion, in which the voltage changes from the minimum value to the maximum value, corresponds to the depressurizing portion P1 for depressurizing the ink within the pressure chamber 424. In addition, a portion, in which the voltage changes from the maximum value to the minimum value, corresponds to the pressurizing portion P3 for pressurizing the ink in order to eject the ink. In addition, a portion, in which the voltage is constant at the maximum value, corresponds to the maintaining portion P2 for maintaining the state of the piezoelectric element 433 at the time of stopping the application of the depressurizing portion P1. Accordingly, the ejection pulse PS does not have a portion (which is referred to as a damping portion) for suppressing excessive reciprocation of the meniscus after the ejection of the ink droplets. The reason is based on the knowledge that movement of meniscus of a high viscosity ink (a high viscosity liquid), which is used in the printer 1, after the ejection of the ink droplets is restored earlier than that of the water-based ink, which is generally used, by the viscosity resistance of the ink. In addition, since the pulse does not have the damping portion, it is possible to shorten the time period required to generate the ejection pulse PS by that amount, and thus it is possible to eject the ink droplets at a high frequency.

In the ejection pulse PS, the generation time period T1 of the depressurizing portion P1 is 2.8 μs, the minimum voltage is 0 V, and the maximum voltage is 23 V. Further, the generation time period T2 of the maintaining portion P2 is 2.8 μs, and the generation time period T3 of the pressurizing portion P3 is 2.4 μs. The driving signal generation circuit 30 generates a steady portion P4 in which the voltage is constant at the minimum value subsequent to the ejection pulse PS. The portion P4 is generated during the time period T4 to the time of starting generation of the next ejection pulse PS, and corresponds to the connection portion. The driving signal generation circuit 30 repeatedly generates for each period T by repeating the driving signal COM including the ejection pulse PS.

The generation time periods of the portions P1 to P3, the maximum voltage, and the minimum voltage of the ejection pulse PS are appropriately adjusted by the type of ink (the liquid) subjected to the ejection, a required flying speed of the ink droplet, the length of the tailing portion of the ink droplet, and the like. In addition, regarding the depressurizing portion P1 and pressurizing portion P3, it is preferred that a volume variation of the pressure chamber 424 per unit time caused by the pressurizing portion P3 be larger than a volume variation of the pressure chamber 424 per unit time caused by the depressurizing portion P 1. The reason is that the depressurizing portion P1 has a function of filling the pressure chamber 424 with the ink and the pressurizing portion P3 has a function of ejecting the ink droplets from the nozzle 427. By adopting such a configuration, it is possible to pressurize the ink with the pressure chamber 424 sufficiently filled with the ink. As a result, when the ink droplets are ejected, it is possible to apply a stronger pressure to the ink in the vicinity of the nozzle 427.

Regarding Reference Example

It has been suggested that the nozzle used in this type of printer has a taper portion (a portion for partitioning a space having the circular truncated cone shape) and a straight portion (a portion for partitioning a space having the cylindrical shape). However, although the nozzle having such a shape is used, sometimes the ejection of the ink droplets becomes unstable. One of the reasons is that change in the pressure of the liquid within the pressure chamber is inefficiently applied to the ejection of the liquid. For example, when the ink droplets are ejected by moving the meniscus within the range of the straight portion, a viscous force of the liquid to the inner wall of the straight portion is stronger than an inertial force of the liquid existing in the center of the straight portion. Hence, it can be considered that this causes disturbance in the ejection of the ink droplets and the ejection amount thereof to be lacking.

Figure 6B:
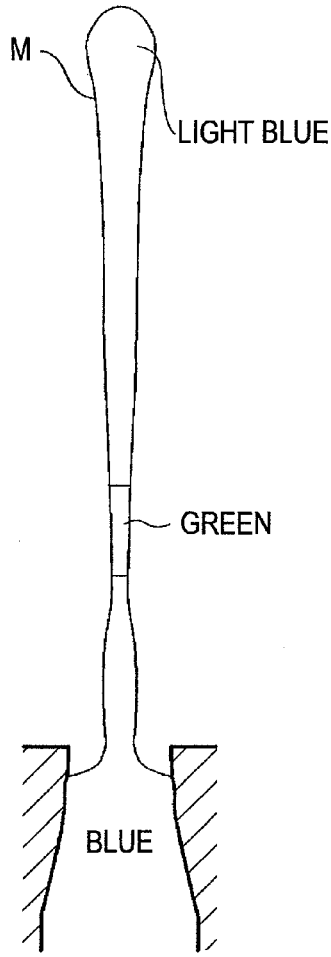
FIG. 6B is a diagram schematically illustrating a shape of a meniscus M and pressure distribution after the application of the pressurizing portion.
Figure 6A:
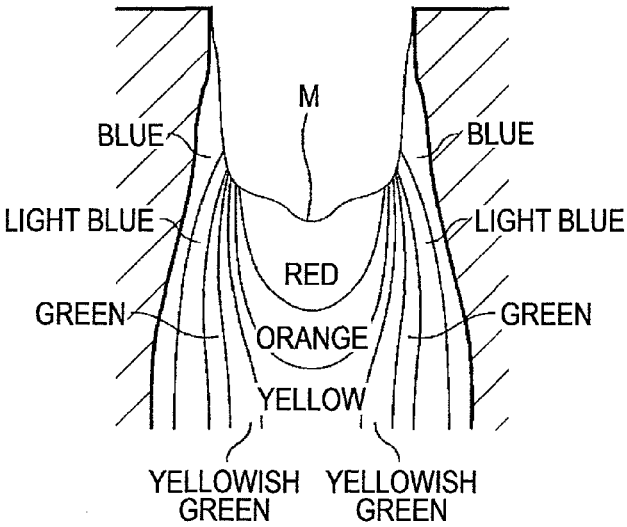
FIG. 6A is a diagram schematically illustrating a shape of a meniscus M and pressure distribution at the time of application of a pressurizing portion.
Figure 6C:
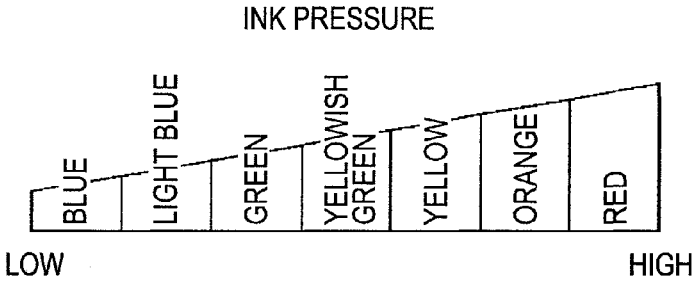
FIG. 6C is a diagram illustrating a relationship between ink pressures and colors.

FIGS. 6A to 6C are diagrams illustrating the case where the ejection becomes unstable in accordance with the pressurizing timing. FIG. 6A is a diagram schematically illustrating a shape of a meniscus M and pressure distribution at the time of application of a pressurizing portion. FIG. 6B is a diagram schematically illustrating a shape of a meniscus M and pressure distribution after the application of the pressurizing portion. FIG. 6C is a diagram illustrating a relationship between ink pressures and colors.

FIG. 6A shows the state where the meniscus M is attracted not to move over the straight portion by applying the depressurizing portion and maintaining portion of the ejection pulse to the piezoelectric element, and the pressurizing portion is applied. In this diagram, the colors such as blue and red represents the pressure of the liquid. That is, as shown in FIG. 6C, the low pressure side is represented by a blue based color, and the high pressure side is represented by a red based color. Specifically, seven levels are classified by using the colors such as blue, light blue, green, yellowish green, yellow, orange, and red in order from the low pressure side. In addition, pressure distribution is represented by drawing isobaric lines at the boundaries between the pressures.

Furthermore, the colors do not represent absolute pressure magnitudes, but represent relative pressure differences. That is, at the time point, the lowest pressure region is represented by blue, and color classification is based on the blue region. Such expression of pressure based on colors is the same as those of the other drawings (FIGS. 9B, 10B, . . . , and 17B).

In FIG. 6A, the red region in which the pressure is highest exists at the bottom of the meniscus M. The red region is distributed in a semi-ellipsoid shape toward the pressure chamber (toward the lower side in the drawing) from the bottom of the meniscus M. Near the red region, the orange region of the second highest pressure is distributed in an arch shape. Further, near the orange region, the yellow region of the third highest pressure is distributed in an approximately Y-shape. In addition, aside the yellow region, the yellowish green region and the green region are distributed, and aside the green region, the light blue region and the blue region are distributed. It can be seen from the drawing that the red, orange, and yellow regions in which the pressure is high are distributed in a state of expansion toward the pressure chamber. From the result that the high pressure portions are distributed in a state of expansion as described above, it can be understood that the ink droplets may not be ejected and the ejection amount may be insufficient because of the lack of the pressure at the leading end of the ink pillar as shown in FIG. 6B.

Figure 7:
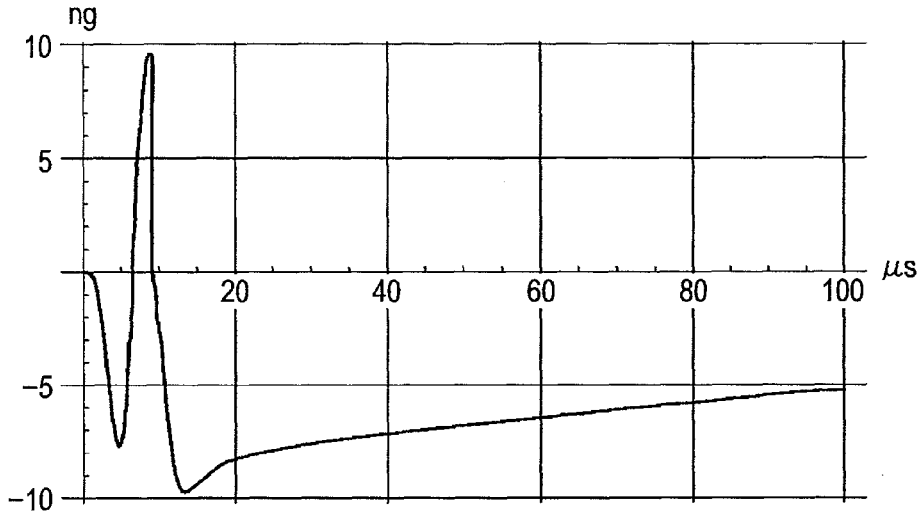
FIG. 7 is a diagram illustrating simulation data for explaining a case where ejection becomes unstable depending on an impedance ratio of a nozzle to an ink supply passage.

FIG. 7 a diagram illustrating simulation data for explaining a case where ejection becomes unstable depending on an impedance ratio of a nozzle to an ink supply passage. In FIG. 7, the vertical axis represents the state of the meniscus M as an amount of the ink, and the horizontal axis represents time. Regarding the vertical axis, 0 ng represents a position of the meniscus M in a steady state. In addition, as the value positively increases, the value represents a state where the meniscus M is pushed in the ejection direction, and as the value negatively increases, the value represents a state where the meniscus M is attracted toward the pressure chamber.

In the simulation data shown in FIG. 7, an impedance of the nozzle is determined to be larger than that of the ink supply passage. Specifically, a diameter of the straight portion in the nozzle is set to 28 μm, a length of the straight portion is set to 20 μm, a length of the nozzle is set to 60 μm, and a taper angle thereof is set to 25 degrees. In addition, a width of the ink supply passage is set to 100 μm, a height thereof is set to 100 μm, and a length thereof is set to 500 μm. Thereby, in the case of the ink of which the viscosity is 30 mPa·s, an impedance of the nozzle is $1.59\times10^{14}\Omega$, and an impedance of the ink supply passage is $1.27\times10^{14}\Omega$. Furthermore, each impedance value is calculated by associating factors such as compliance, resistance, and inertance with values of an electric circuit.

As described above, when the impedance of the nozzle is larger than that of the ink supply passage, a problem arises in that the pressure change of the ink within the pressure chamber is inefficiently applied to the ejection of the ink. That is, most of the pressure change of the ink within the pressure chamber is transferred to the common ink chamber through the ink supply passage. Thereby, the mobility of the meniscus M relative to the pressure change of the ink decreases. Therefore, the ink droplets may not be ejected, and an insufficient ejection amount occurs. Further, it takes time for the meniscus M to restore the steady state after the ejection of the ink droplets. The reason can be considered as follows. First, when the impedance of the nozzle is large, a viscous force of the nozzle surface excessively increases. Second, even in a state where the meniscus M is attracted toward the pressure chamber, the difference between the ink pressure within the pressure chamber and the ink pressure within the common ink chamber decreases, and thus ink flow becomes weak in the range from the common ink chamber side to the pressure chamber side. In other words, the reason is that a surface tension of the meniscus M is dominant.

Regarding Characteristics of Printer 1

In consideration of the above mentioned situation, in the printer 1, the following configuration is adopted in order to improve characteristics of the ejection of the ink droplets. First, the nozzle 427 is configured to have a taper portion 427*a* in which the ink ejection side thereof has a smaller opening area than the pressure chamber 424 side thereof and a straight portion 427*b* which communicates with the ejection side end portion of the taper portion 427*a* (refer to FIG. 8A and the like). Further, the ejection pulse PS is configured as follows: the depressurizing portion P1 depressurizes the ink within the pressure chamber 424 in order to attract the meniscus M, which is positioned in the straight portion 427*b*, to the taper portion 427*a*; the pressurizing portion P3 pressurizes the ink in order to eject the ink; and the time of starting the application of the pressurizing portion P3 is determined as a time before the meniscus M attracted up to the taper portion 427*a* returns to the straight portion 427*b*. With such a configuration, when the ink within the pressure chamber 424 is pressurized by applying the pressurizing portion P3 to the piezoelectric element 433, the local ink pressure of the taper portion 427*a* close to the straight portion 427*b* can be made to be high. In other words, it is possible to concentrate the high pressure portion of the ink on the vicinity of the meniscus M. Hence, it is possible to efficiently apply the pressure change of the ink to the ejection of the ink droplets. As a result, even when the ink has a high viscosity, it is possible to efficiently eject the ink. In addition, since the straight portion 427*b* is provided, it is possible to regulate the flying directions of the ink droplets within an allowable range. That is, it is possible to stabilize the flying direction. Furthermore, the maintaining portion P2 is generated between the depressurizing portion P1 and the pressurizing portion P3. Hence, by setting the generation time period of the maintaining portion P2, it is possible to conveniently set a timing at which the pressurizing portion P3 pressurizes the ink.

Further, in the printer 1, the following configuration of the head HD is adopted. That is, regarding the nozzle 427 and the ink supply passage 425, an impedance Z427 of the nozzle 427 is set to be smaller than an impedance Z425 of the ink supply passage 425 (the liquid supply section). With such a configuration, when the pressure of the ink within pressure chamber 424 is changed by allowing the piezoelectric element 433 to deform the diaphragm section 423*a*, it is possible to increase a rate of movement of the meniscus M caused by the pressure change as compared with the known techniques. Thereby it is possible to concentrate the high pressure portion on the taper portion 427*a* of the nozzle 427 close to the straight portion 427*b*. Accordingly, it is possible to efficiently apply the pressure change of the ink to the ejection of the ink droplets. As a result, even when the ink has a high viscosity, it is possible to efficiently eject the ink.

Regarding Shape and the Like of Nozzle 427

Figure 8A:
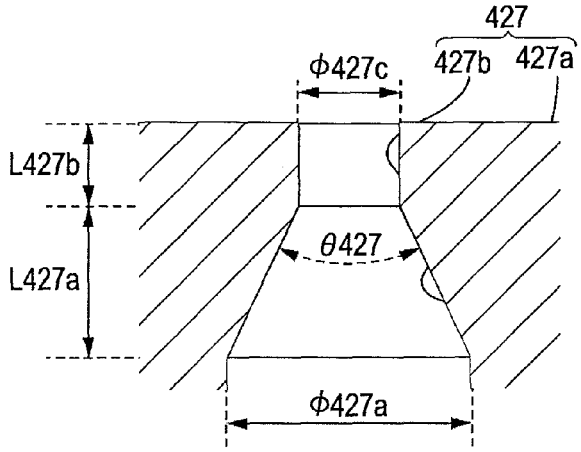
FIG. 8A is a sectional view illustrating a shape of the nozzle.
Figure 8B:
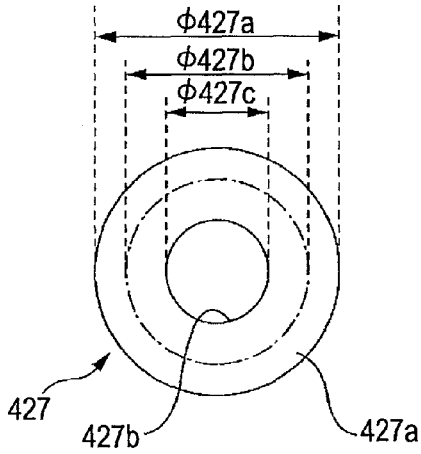
FIG. 8B is a view of the nozzle as viewed from the taper portion side.

Hereinafter, characteristics thereof will be described in detail. First, a shape of the nozzle 427 and a shape of the ink supply passage 425 will be described. As shown in FIGS. 8A and 8B, the nozzle 427 is formed in a funnel shape, and has the taper portion 427*a* formed in a taper shape and the straight portion 427*b* communicating with the ejection side end portion of the taper portion 427*a*. The taper portion 427*a* is a portion for partitioning the space having the circular truncated cone shape, and corresponds to the first portion in the nozzle 427. The straight portion 427*b* corresponds to the second portion in the nozzle 427, and is a portion for partitioning the space having the cylindrical shape as a shape of which a sectional area scarcely changes on a plane orthogonal to the nozzle direction. In other words, the sectional shape in a direction orthogonal to the ejection direction is fixed as a circular shape even at any location in the ejection direction. The opening area of the taper portion 427*a* increases as it becomes closer to the pressure chamber 424 (the lower side in FIG. 8A). Specifically, an opening area thereof close to the ink droplet ejection side is set to be smaller than an opening area thereof close to the pressure chamber 424. For example, a diameter ϕ427*b* of the taper portion 427*a* at the center position thereof is smaller than a diameter ϕ427*a* of the end portion thereof close to the pressure chamber 424. In addition, a diameter ϕ427*c* of the ejection side end portion (the end portion close to the straight portion 427*b*) is smaller than the diameter ϕ427*b* thereof at the central position.

In the embodiment, the diameter ϕ427*c* of the ejection side end portion corresponds to the diameter of the straight portion 427*b*, and is set to 30 μm. A length L427*b* of the straight portion 427*b*, that is, a length thereof in the ejection direction is set to 20 μm, and a length L427*a* of the taper portion 427*a* is set to 80 μm. Hence, the length L427 of the nozzle 427 is set to 100 μm. In addition, the taper angle θ427 is set to 50 degrees. On the other hand, a width W425 of the ink supply passage 425 is set to 100 μm, a height H425 thereof is set to 100 μm, and a length L425 thereof is set to 500 μm. As a result, the impedance Z427 of the nozzle 427 is smaller than the impedance Z425 of the ink supply passage 425. Specifically, in the case of the ink of which the viscosity is 30 mPa·s, the impedance Z427 of the nozzle 427 is $1.0\times10^{14}\Omega$, and the impedance Z425 of the ink supply passage 425 is $1.27\times10^{14}\Omega$.

Regarding Ink Ejection Control

Next, ink ejection control will be described. FIGS. 9 to 17 shows states of the ink in the vicinity of the nozzle 427 at the time of the ejection of the ink droplets for each elapsed time from the time of starting the application of the ejection pulse PS. That is, FIGS. 9A, 10A, . . . , and 17A show elapsed times from the time of starting the application of the ejection pulse PS and voltages at the time. In addition, FIGS. 9B, 10B, . . . , and 17B schematically show states of the meniscus M and pressure distribution at the times in FIGS. 9A, 10A, . . . , and 17A. Furthermore, the simulation is performed by using ink of which the viscosity is 30 mPa·s.

Figure 9A:
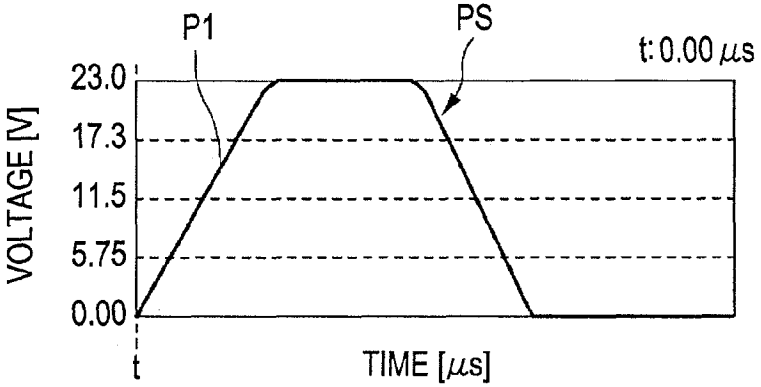
FIG. 9A is a diagram illustrating a voltage at the time of starting the application of an ejection pulse.
Figure 9B:
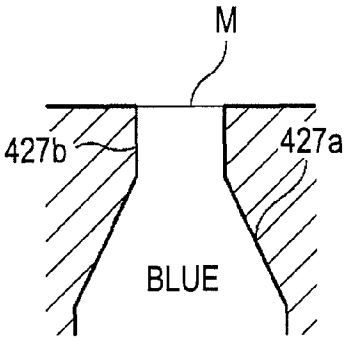
FIG. 9B is a diagram schematically illustrating a state of the meniscus and pressure distribution at the time in FIG. 9A.
Figure 10A:
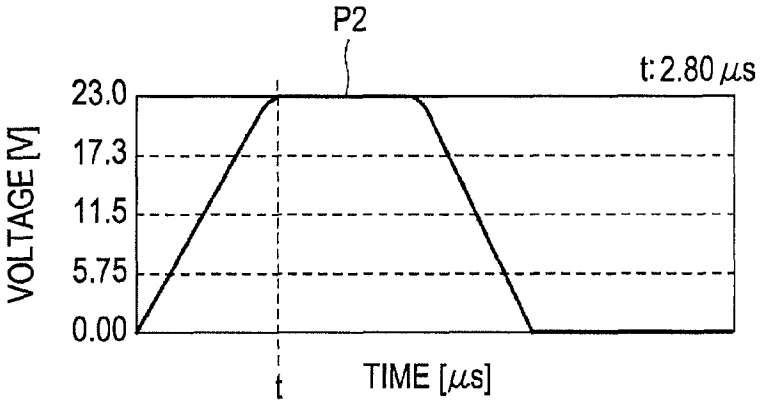
FIG. 10A is a diagram illustrating a voltage after 2.80 μs elapses from the time of starting the application of the ejection pulse.
Figure 10B:
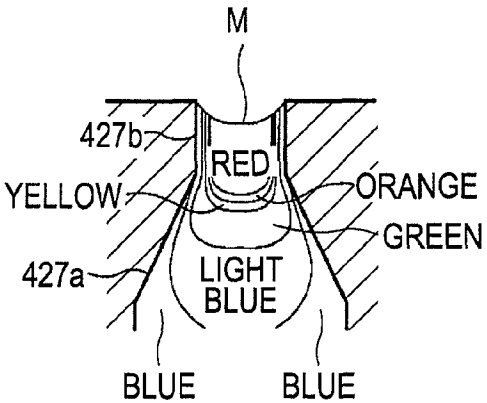
FIG. 10B is a diagram schematically illustrating a state of the meniscus and pressure distribution at the time in FIG. 10A.

As shown in FIGS. 9A and 9B, the meniscus M is in the steady state just before the time (0.00 μs) of starting the application of the ejection pulse PS, and the ink pressure is stabilized at the minimum level (blue). As shown in FIGS. 10A and 10B, the meniscus M is slightly curved toward the pressure chamber 424 at the time (2.80 μs) of stopping the application of the depressurizing portion P1, and the red region is distributed from the bottom of the meniscus M toward the pressure chamber 424. The red region is distributed in a substantially rectangular shape, and occupies a large area in the straight portion 427*b*. As described above, the classification of the pressure represents the relative pressure difference. Hence, the red region represents that the pressure in the region becomes relatively higher since the pressure of the ink around the region becomes lower. Around the red region, the orange region is distributed to involve the red region, and the yellow region is distributed to involve the orange region. Those regions are distributed like thin layers. Outside the yellow region, the green region is distributed. A portion (the bottom portion) of the green region close to the pressure chamber 424 is thicker than a portion of the orange region and a portion of the yellow region close to the pressure chamber 424. That is, the portion of the green region is widely distributed toward the pressure chamber 424. Outside the green region, the light blue region is distributed. A distribution range of the light blue region is larger than that of the green region. In particular, a portion of the light blue region close to the pressure chamber 424 is larger than that of the green region. In addition, outside the light blue region, the blue region is distributed. In this situation, since the orange region and the yellow region is thin (the intervals of the isobaric lines are narrow), it can be said that high pressure regions are concentrated on the red region and the vicinity thereof From this, it can be seen that a strong force to move the meniscus M toward the pressure chamber 424 is applied to the meniscus M.

Figure 11A:
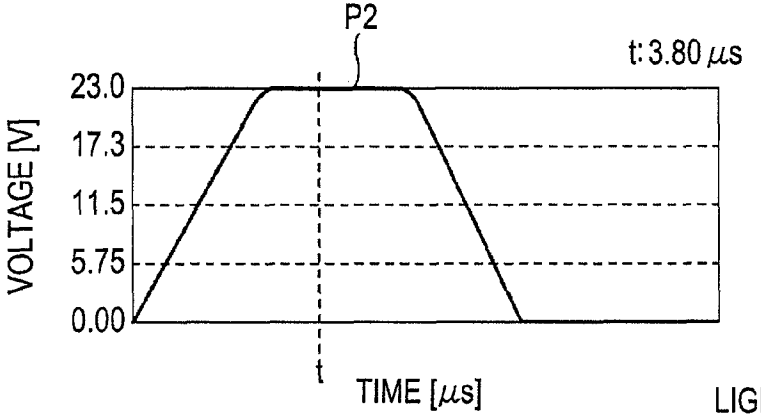
FIG. 11A is a diagram illustrating a voltage after 3.80 μs elapses from the time of starting the application of the ejection pulse.
Figure 11B:
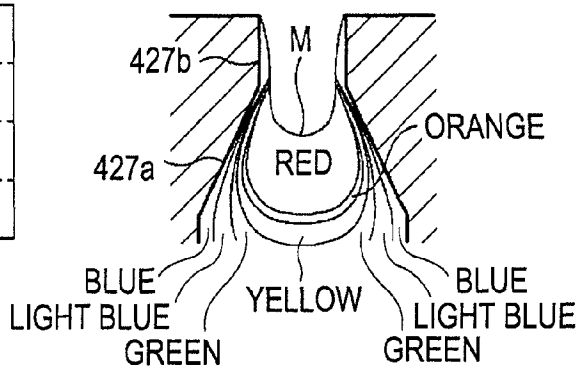
FIG. 11B is a diagram schematically illustrating a state of the meniscus and pressure distribution at the time in FIG. 11A.

As shown in FIGS. 11A and 11B, the center of the meniscus M passes over the straight portion 427*b* and reaches the taper portion 427*a* at the time (3.80 μs) in the time period of applying the maintaining portion P2. At this time, the red region in which the pressure is highest is distributed in an oval sphere shape like the head of a match in the taper portion 427*a*. In addition, the orange region is distributed to involve the red region, and the yellow region is distributed to involve the orange region. Likewise, other regions are distributed to involve the inside regions. In this situation, the orange region and the yellow region are thinly distributed around the distribution range of the red region. From this, it can be seen that the strong force to move the meniscus M toward the pressure chamber 424 is still applied to the meniscus M.

Figure 12A:
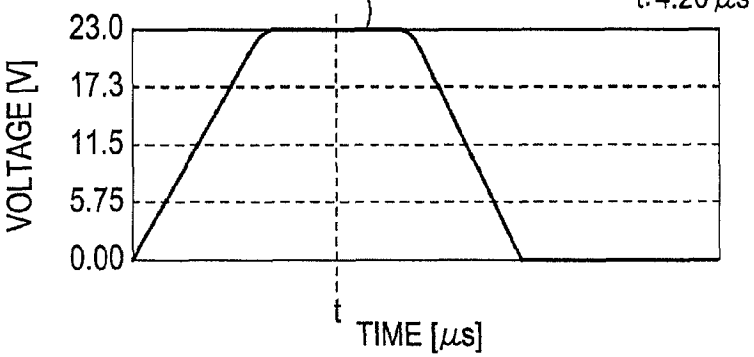
FIG. 12A is a diagram illustrating a voltage after 4.20 μs elapses from the time of starting the application of the ejection pulse.
Figure 12B:
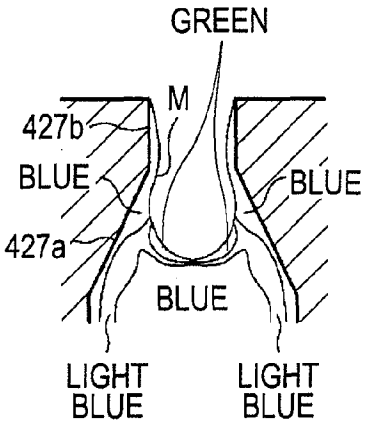
FIG. 12B is a diagram schematically illustrating a state of the meniscus and pressure distribution at the time in FIG. 12A.

As shown in FIGS. 12A and 12B, the center of the meniscus M is attracted up to the center of the taper portion 427*a* at the time (4.20 μs) in the time period of applying the maintaining portion P2. In addition, around the meniscus M, the light blue region is mostly distributed and the green region is distributed in some portions. As described above, the red region and the orange region representing a high pressure disappear. The reason may be that the pressure difference decreases since energy is consumed by attracting the meniscus M. Thereby, the meniscus M stops movement toward the pressure chamber 424, and subsequently starts to move in the ejection direction. The reason why the meniscus M starts to move in the ejection direction can be considered as follows. First, the ink flows therein from the ink supply passage 425 due to the depressurization of the pressure chamber 424. Second, the meniscus M tends to return to the steady state due to the surface tension.

Figure 13A:
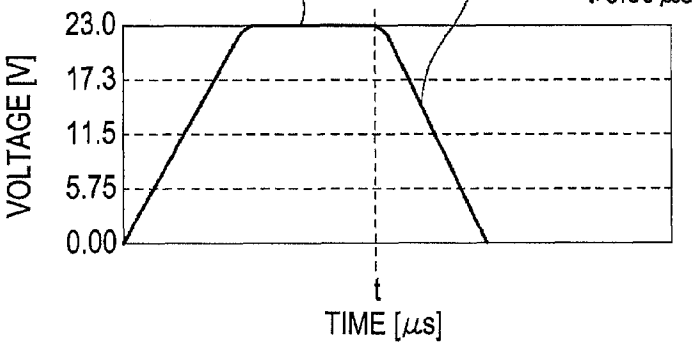
FIG. 13A is a diagram illustrating a voltage after 5.60 μs elapses from the time of starting the application of the ejection pulse.
Figure 13B:
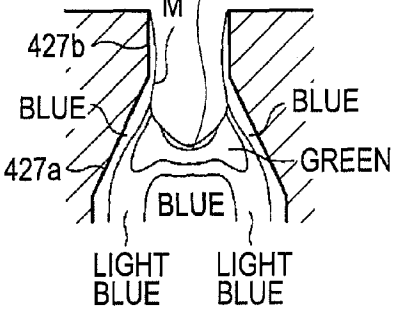
FIG. 13B is a diagram schematically illustrating a state of the meniscus and pressure distribution at the time in FIG. 13A.
Figure 14A:
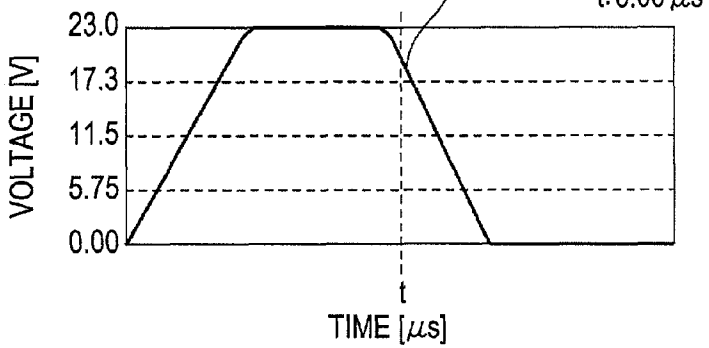
FIG. 14A is a diagram illustrating a voltage after 6.00 μs elapses from the time of starting the application of the ejection pulse.
Figure 14B:
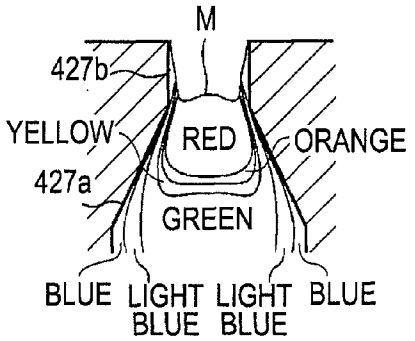
FIG. 14B is a diagram schematically illustrating a state of the meniscus and pressure distribution at the time in FIG. 14A.
Figure 15A:
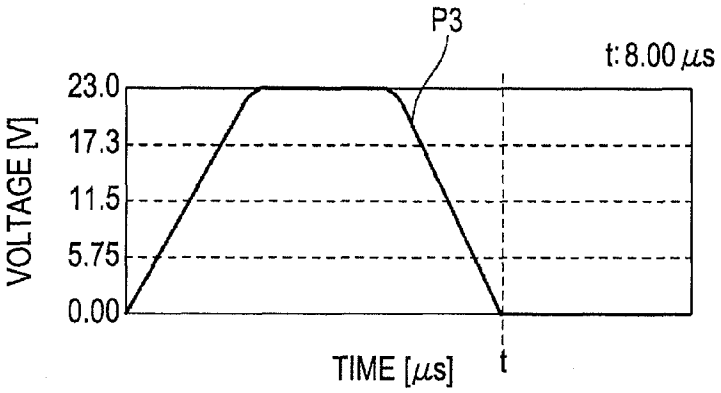
FIG. 15A is a diagram illustrating a voltage after 8.00 μs elapses from the time of starting the application of the ejection pulse.
Figure 15B:
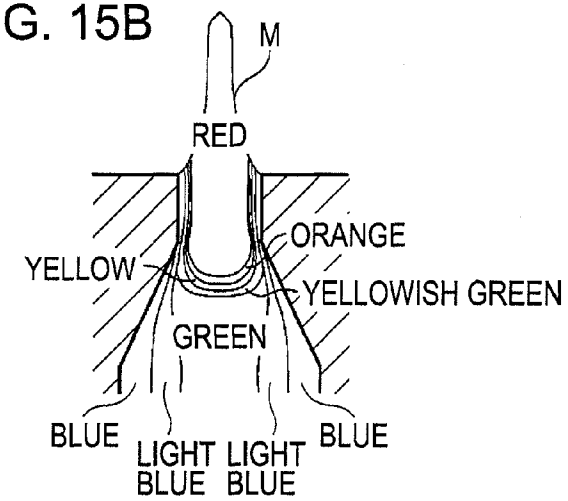
FIG. 15B is a diagram schematically illustrating a state of the meniscus and pressure distribution at the time in FIG. 15A.

As shown in FIGS. 13A and 13B, at the time (5.60 μs) of starting the application of the pressurizing portion P3, the center of the meniscus M is positioned in the vicinity (the end of the taper portion) of the straight portion 427*b* in the taper portion 427*a*. This time corresponds to the time before the meniscus M attracted up to the taper portion 427*a* returns to the straight portion 427*b*. As shown in FIGS. 14A and 14B, at the time (6.00 μs) just after the start of the application of the pressurizing portion P3, the center of the meniscus M (the bottom portion) is positioned at the end of the straight portion 427*b* close to the pressure chamber 424. This time corresponds to the time at which the meniscus M attracted up to the taper portion 427*a* returns to the straight portion 427*b*. In addition, in a portion of the meniscus M closer to the pressure chamber 424 than the bottom thereof, the red region is distributed in a substantially trapezoidal shape. Further, the orange region is distributed to involve the red region, and the yellow region is distributed to involve the orange region. In addition, outside the yellow region, the green region is distributed. Here, the orange region and the yellow region are distributed in a small range. That is, the isobaric lines are densely distributed. This means that the high pressure portions are concentrated on the vicinity of the meniscus M. As shown in FIGS. 15A and 15B, at the time (8.00 μs) of stopping the application of the pressurizing portion P3, the red region is distributed in the range of most of the ink existing in the straight portion 427*b* and a portion projected out of the nozzle 427. The orange region is distributed to involve the circumference of the red region, the yellow region is distributed to involve the orange region, and the yellowish green region is distributed to involve the yellow region. In addition, those regions are distributed in the narrow range similarly to FIG. 14B. Accordingly, at the time of stopping the application of the pressurizing portion P3, a pressure of the ink within the straight portion 427*b* of the nozzle 427 and a pressure of the ink within a portion which is projected from the nozzle 427 in a pillar shape are higher than ink pressures within the other portions.

Here, the reason why the high pressure portions can be concentrated is described. It can be inferred that this is caused by an operation of the taper portion 427*a*. Specifically, when the ink is pressurized by contracting the pressure chamber 424, the force also has influence on the ink within the nozzle 427. When the force (a suppressive strength in the ejection direction) is applied to the ink, the ink flows along the taper portion 427*a*. Since the flow passage, through which the ink flows, tapers off in the taper portion 427*a*, the force applied to the ink becomes larger, whereby the internal stress is concentrated on the ink. Therefore, it is possible to concentrate the high pressure portion on the boundary portion between the taper portion 427*a* and the straight portion 427*b*. In addition, the time of pressurizing the ink is set to a time just before the meniscus M attracted up to the taper portion 427*a* returns to the straight portion 427*b*. In other words, the ink is pressurized in a state where the amount of ink of the straight portion 427*b* is at the minimum. Thereby, it is possible to concentrate the pressure on the ink which exists in the ejection side end portion of the taper portion 427*a*, and thus it is possible to locally and intensively pressurize the ink. This point also makes the high pressure portions be concentrated. Furthermore, since the operation of the taper portion 427*a* is used, it is preferred that the maximum degree of the attraction for the meniscus M be set not to be over the taper portion 427*a*.

Figure 16A:
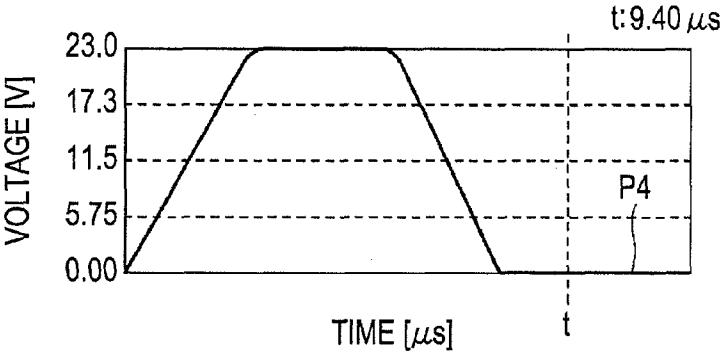
FIG. 16A is a diagram illustrating a voltage after 9.40 μs elapses from the time of starting the application of the ejection pulse.
Figure 16B:
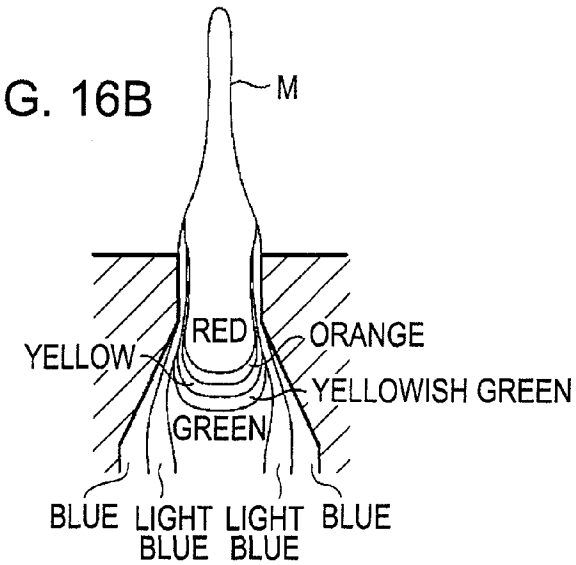
FIG. 16B is a diagram schematically illustrating a state of the meniscus and pressure distribution at the time in FIG. 16A.
Figure 17B:
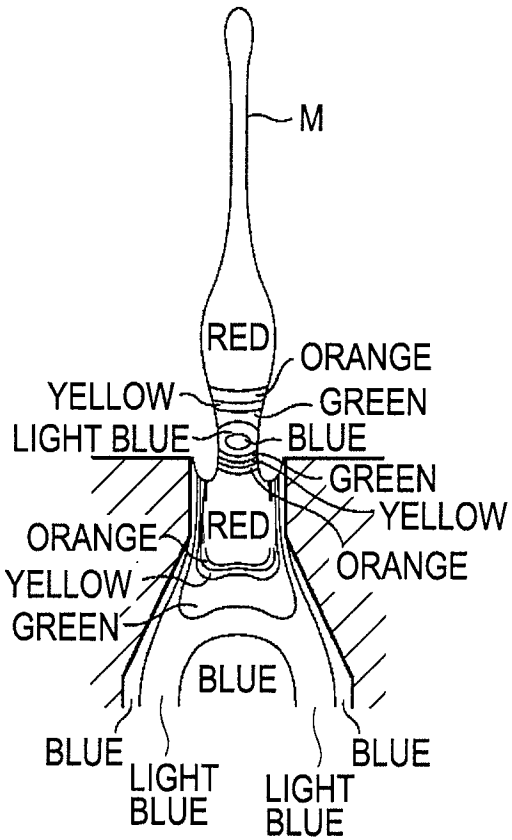
FIG. 17B is a diagram schematically illustrating a state of the meniscus and pressure distribution at the time in FIG. 17A.
Figure 17A:
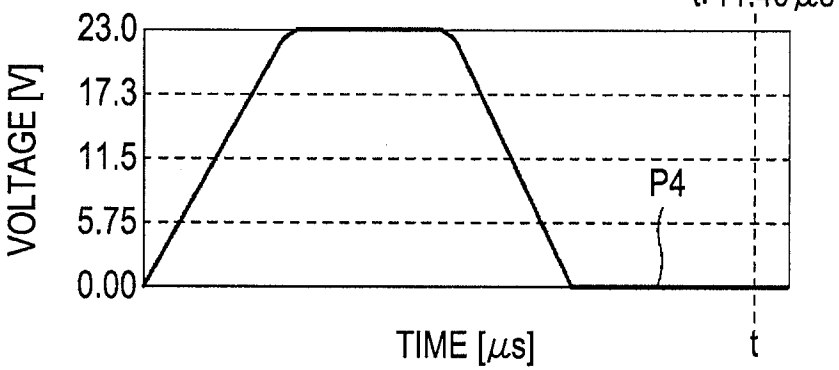
FIG. 17A is a diagram illustrating a voltage after 11.40 μs elapses from the time of starting the application of the ejection pulse.

As a result of such a control, it is possible to increase the pressure of the ink on the ejection side rather than that of the ink within the straight portion 427*b* as shown in FIGS. 16A and 16B. Thus, it is possible to create an ink pillar which moves at a speed sufficient to eject the ink droplet. Furthermore, as shown in FIGS. 17A and 17B, it is possible to eject the leading end portion of the ink pillar as the ink droplet. That is, since the blue region having an elliptical shape exists in the portion in which the ink pillar is narrow, the ink pillar is cut off in this portion. Then, the leading end portion ahead of the elliptical region is ejected as the ink droplet. Here, most of the portion ejected as the ink droplet is the red region. From this, it can be seen that the pressure change of the ink within the pressure chamber 424 is efficiently applied to the ejection of the ink droplet. Accordingly, it is possible to suppress a phenomenon in which the tailing portion of the ink droplet excessively elongates. Furthermore, the portion of the ink closer to the pressure chamber 424 than the elliptical region forms a new meniscus M.

Regarding Taper Angle θ427

The above mentioned data is based on the taper angle θ427 of 50 degrees. The reason why the stress is concentrated is based on the movement of the ink in the taper portion 427*a*. In consideration of this, the taper angle θ427 is examined. Here, an evaluation is conducted in the following way: the taper angle θ427 is set to 20 degrees, 25 degrees, 30 degrees, 40 degrees, 50 degrees, 60 degrees, and 80 degrees; and the inks having viscosities of 8 mPa·s, 10 mPa·s, 15 mPa·s, 20 mPa·s, 30 mPa·s, and 40 mPa·s are ejected from the nozzles 427 corresponding to the respective taper angles. Furthermore, data other than the data exemplified herein is as described above. In this evaluation, the shape of the nozzle 427 is also determined so that the impedance Z427 of the nozzle 427 is smaller than the impedance Z425 of the ink supply passage 425. In addition, the nozzle 427 of which the taper angle θ427 is 80 degrees or more is excluded from the evaluation target. The reason is that if the angle is 80 degrees or more (for instance, if a taper surface is provided with an angle within an angular range in which it is not an acute angle), the ink flows along the taper surface, and thus the effect of the pressure concentration is obtained. In this case, the maximum angle of the taper depends on a width of the pressure chamber 424, a pitch of the nozzle 427, a length of the nozzle 427, and the like.

FIG. 18 shows a list of the evaluation results. In the drawing, the item of the column is the viscosity of the ink, and the item of the row is the taper angle θ427. In addition, in the evaluation results, the sign x means that the ink does not have a droplet shape and is not ejected. Further, the sign Δ means that the tailing portion, which is created in the rear of the ink droplet in the flying direction, has a length which may cause trouble in the printer 1. In this evaluation, when a length of the tailing portion is larger than 500 μm the evaluation result is represented by the sign Δ. Accordingly, the sign o means that the trailing portion has a length which does not cause trouble in the printer 1.

This evaluation result can be described as follows. That is, since there is a correlation between the taper angle θ427 and the viscosity of the ink, it may be preferred that the taper angle θ427 be set to be larger as the ink has a higher viscosity. This can be understood from the evaluation x which means that ink can not be ejected. For example, when the taper angle is 20 degrees, the ink having a viscosity of 20 mPa·s or more is evaluated as ×. When the taper angle is 25 degrees and 30 degrees, the ink having a viscosity of 30 mPa·s or more is evaluated x. In addition, when the taper angle is not less than 40 degrees and not more than 60 degrees, the ink having a viscosity of 40 mPa·s is evaluated x. Further, when the taper angle is not less than 80 degrees, the ink having a viscosity of 40 mPa·s is evaluated as Δ.

Focusing attention on evaluation o, it can be seen that an appropriate range of the taper angle θ427 depending on the viscosity of the ink exists. For example, it can be seen that, when the ink having a viscosity not less than 8 mPa·s and not more than 15 mPa·s is ejected, a taper angle θ427 of 40 degrees or more is allowed. In addition, it can be seen that, when the ink having a viscosity not less than 8 mPa·s and not more than 30 mPa·s is ejected, a taper angle θ427 of 50 degrees or more is allowed.

Next, the length L427*a* of the taper portion 427*a* is examined. When the taper portion 427*a* is provided, an operation effect is obtained which concentrates the stress on the portion of the taper portion 427*a* closer to the straight portion 427*b*. Accordingly, it can be said that the length thereof is not related thereto. Here, it is required that the high viscosity ink be more stably ejected. From this viewpoint, it can be said that the length L427*a* is preferably a length (a half of the length L427 of the nozzle 427) not less than that of the straight portion 427*b*. In addition, in the above mentioned simulation, the length L427 of the nozzle 427 is 100 μm and 80 μm of the nozzle length is the length L427*a* of the taper portion 427*a*. Therefore, it can be said that the length L427*a* of the taper portion 427*a* is more preferably ⅘ of the length L427 of the nozzle 427. As described above, by increasing the ratio of the length L427*a* of the taper portion 427*a* to the length L427 of the nozzle 427, it is possible to easily obtain the high pressure portion.

Regarding Impedance

As described above, in the head HD used in the simulation, in the case of the ink of which the viscosity is 30 mPa·s, the impedance Z427 of the nozzle 427 is $1.0\times10^{14}\Omega$, and the impedance Z425 of the ink supply passage 425 is $1.27\times10^{14}\Omega$. That is, the impedance Z427 of the nozzle 427 is smaller than the impedance Z425 of the ink supply passage 425. Here, values of the impedances are changed in accordance with the viscosity of the ink. Hence, the values of the impedances are changed by using an ink having a different viscosity. However, the relationship that the impedance Z427 of the nozzle 427 is smaller than the impedance Z425 of the ink supply passage 425 is established regardless of the viscosity of the ink.

As described above, the impedance Z427 of the nozzle 427 is set to be smaller than the impedance Z425 of the ink supply passage 425. In this case, when the pressure of the ink within the pressure chamber 424 is changed, it becomes difficult (acoustically heavy) to cause the ink to flow toward the ink supply passage 425 having a large impedance, and it becomes easy (acoustically light) to cause the ink to flow toward the nozzle 427 having a small impedance. Thereby, it is possible to efficiently move the meniscus M by changing the pressure of the ink. In addition, residual oscillation (pressure oscillation applied to the ink within the pressure chamber 424) generated after the ejection of the ink droplet tends to remain in the pressure chamber 424. This makes easy to cause the ink to flow in the pressure chamber 424 from the common ink chamber 426. Thereby, it is possible to return meniscus M to the steady state in an early stage, and thus it is possible to eject the ink droplets at a high frequency.

FIG. 19 is a diagram illustrating the description mentioned above, and is simulation data corresponding to FIG. 7. When the simulation data is obtained, the shape data of the nozzle 427 and the ink supply passage 425 is as described above. That is, the impedance Z427 of the nozzle 427 is $1.0\times10^{14}\Omega$, and the impedance Z425 of the ink supply passage 425 is $1.27\times10^{14}\Omega$. As shown in FIG. 19, the meniscus M returns to the position in the substantially steady state at the time point at which 100 μm has elapsed from the start of the application of the ejection pulse PS. In the embodiment, a criterion for determining whether the ink droplet can be stably ejected even at a high frequency of about 40 kHz is that the meniscus M returns to the position in the steady state at the time point at which 100 μs has elapsed from the start of the application of the ejection pulse PS. Here, from the result shown in FIG. 19, it can be inferred that since the minimum interval of the ejection of the ink droplets is 100 μs, the maximum ejection frequency is about 10 kHz. However, when the ejection frequency is increased, the ink droplets are ejected one by one. From this, it can be inferred that the ink flow from the common ink chamber 426 toward the nozzle 427 is generated in the ink flow passage (the successive flow passage from the common ink chamber 426 to nozzle 427). It can be inferred that since the ink flow becomes faster as the ejection frequency increases, this helps to supply the ink to the pressure chamber 424. From the above, the criterion is determined. In addition, when the ink droplets of 10 ng or more can be ejected at a frequency of about 40 kHz, even in the case of the high viscosity ink, it is possible to exhibit the same performance as the printer for ejecting the existing water-based ink.

In addition, in order to decrease the impedance Z427 of the nozzle 427, it is preferred that the length L427*b* of the straight portion 427*b* be set to be smaller than the diameter ϕ427*b*. With such a configuration, it is possible to decrease inertance and flow passage resistance. Specifically, the inertance is calculated by multiplying the length L427*b* of the straight portion 427*b* by an ink density and by dividing the multiplication by the opening area. Therefore, the calculated value decreases as the opening area increases (as the diameter ϕ427*b* increases). Further, the flow passage resistance decreases as the length L427*b* of the straight portion 427*b* decreases and as the opening area increases. Accordingly, it can be said that making the length L427*b* of the straight portion 427*b* smaller than the diameter ϕ427*b* is an effective means for decreasing the impedance Z427 of the nozzle 427.

Conclusion

The following can be understood from the description mentioned above. That is, the nozzle 427 has the taper portion 427*a* (the first portion) in which the ink ejection side thereof has a smaller opening area than the pressure chamber 424 side thereof and the straight portion 427*b* (the second portion) which communicates with the ejection side end portion of the taper portion 427*a*. The impedance Z427 of the nozzle 427 is set to be less than the impedance Z425 of the ink supply passage 425 (the liquid supply section). Hence, the pressure oscillation caused in the ink within the pressure chamber 424 is efficiently transferred to the nozzle 427. Therefore, it is possible to efficiently eject the ink having a high viscosity.

Further, the taper portion 427*a* partitions the space of the circular truncated cone shape having a taper angle of 40 degrees or more. Therefore, it is possible to suppress the phenomenon that the tailing portion of the ink droplet excessively elongates. In addition, the taper portion 427*a* is set to have an angle within the range according to the viscosity of the ink. Therefore, it is possible to improve the effect mentioned above. The straight portion 427*b*, which communicates with the taper portion 427*a*, is formed in a shape of which a sectional area scarcely changes on the plane orthogonal to the nozzle direction. Thereby, it is possible to stabilize the flying direction of the ejected ink droplets. In addition, the length (the length in the ejection direction) of the straight portion 427*b* is smaller than the diameter ϕ427*b* (an inner diameter of the opening portion) of the straight portion 427*b*. Hence, it is possible to efficiently transfer the pressure oscillation, which is applied to the ink within the pressure chamber 424, to the nozzle 427.

Further, in the ejection control using the ejection pulse PS, the ejection pulse PS has: the depressurizing portion P1 for depressurizing the ink within the pressure chamber 424 in order to attract the meniscus M, which is positioned in the straight portion 427*b*, to the taper portion 427*a*; the pressurizing portion P3 for pressurizing the ink in order to eject the ink before the meniscus M attracted up to the taper portion 427*a* returns to the straight portion 427*b*. Therefore, it is possible to efficiently apply the pressure of the ink to the ejection of the ink. In addition, the maintaining portion P2 is generated between the depressurizing portion P1 and the pressurizing portion P3. Therefore, it is possible to easily optimize the timings.

The Other Embodiments

The above-mentioned embodiments mainly described the printing system having a printer 1 as a liquid ejecting apparatus. However, disclosures of the liquid ejecting method and the liquid ejecting system are included therein. Further, disclosures of the liquid ejecting head and the method of controlling the liquid ejecting head are also included therein. Furthermore, the embodiment is for helping to understand the invention, and is not for limitedly analyzing the invention. It is apparent that the invention may be modified without departing from the technical spirit thereof and the invention may include the equivalents thereof In particular, the following embodiments are also included in the invention.

Regarding Shape of Nozzle 427

Figure 20A:
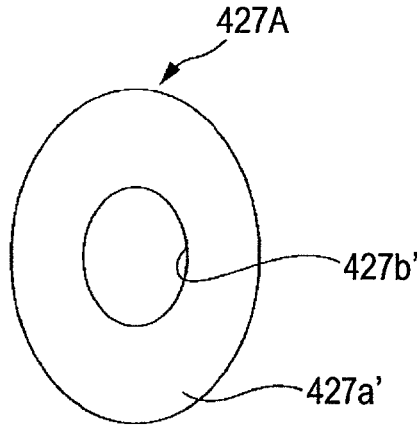
FIG. 20A is a diagram illustrating a first modified example of the nozzle.
Figure 20B:
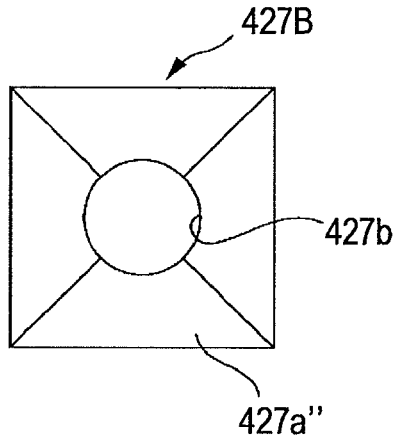
FIG. 20B is a diagram illustrating a second modified example of the nozzle.
Figure 20C:
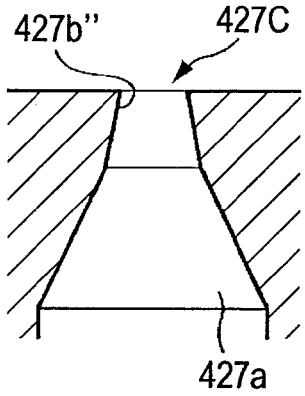
FIG. 20C is a diagram illustrating a third modified example of the nozzle.

In the above-mentioned embodiments, the nozzle 427 has the taper portion 427*a* for partitioning the space (the flow passage) having the circular truncated cone shape and the straight portion 427*b* for partitioning the space having the cylindrical shape. However, the nozzle 427 is not limited to these shapes. It may be preferred that the opening area of the liquid ejection side thereof is smaller than that of the pressure chamber 424 side thereof For example, like the nozzle 427A shown in FIG. 20A, the taper portion 427*a*' and the straight portion 427*b*' may be modified to have elliptical shapes. Further, like the nozzle 427B shown in FIG. 20B, the portion 427*a*" having a quadrangular pyramid shape may be provided instead of the taper portion 427*a*. Even when these nozzles 427A and 427B are applied, the same effect can be obtained. Further, like the nozzle 427C shown in FIG. 20C, the first taper portion 427*a* on the pressure chamber 424 side and the second taper portion 427*b*" on the ejection side may be provided. In the nozzle 427C, the second taper portion 427*b*" corresponds to a portion for partitioning the space formed in a different circular truncated cone shape which has a smaller taper angle than the portion formed in the circular truncated cone shape partitioned by the first taper portion 427*a*. In the nozzle 427C, it is possible to increase the flying speed of the ink droplets.

Regarding Element for Performing Ejection Operation

In the printer 1, the piezoelectric element 433 is used as an element for performing the operation for ejecting the ink. Here, the element for performing the ejection operation is not limited to the above-mentioned piezoelectric element 433. However, it may be preferred that the element be able to change the pressure of the liquid within the pressure chamber 424 by performing the operation in accordance with the applied electric potential. For example, a magnetostrictive element may be used. In addition, when the piezoelectric element 433 is used as the element similarly to the above-mentioned embodiment, it is possible to precisely control the volume of the pressure chamber 424 on the basis of the voltage of the ejection pulse PS. Consequently, it is possible to minutely control the pressure of the ink within the pressure chamber 424.

Regarding Other Application Examples

Further, in the above-mentioned embodiments, the printer 1 was described as a liquid ejecting apparatus, but this does not limit the invention. For example, the same technique as the embodiment may be applied to various liquid ejecting apparatuses, which use inkjet techniques, such as a color filter manufacturing apparatus, a dyeing apparatus, a microscopic processing apparatus, semiconductor manufacturing apparatus, a surface processing apparatus, a three-dimensional modeling apparatus, a liquid evaporation apparatus, an organic EL manufacturing apparatus (particularly, a polymer EL manufacturing apparatus), a display manufacturing apparatus, coating apparatus, a DNA chip manufacturing apparatus. Further, methods therefor and manufacturing methods are also included in an allowable application range.

The entire disclosure of Japanese Patent Application No. 2008-284631, filed Nov. 5, 2008 is expressly incorporated by reference herein.

What is claimed is:

1. A liquid ejecting apparatus comprising:

a pressure chamber that communicates with a liquid supply section and a nozzle;

a piezoelectric element that changes a pressure of liquid within the pressure chamber; and an ejection pulse generation section that generates an ejection pulse for operating the piezoelectric element in order to eject the liquid from the nozzle, wherein the piezoelectric element is deformed in accordance with an electric potential of the applied ejection pulse so as to change a volume of the pressure chamber and thereby change the pressure of the liquid, wherein a viscosity of the liquid is not less than 8 millipascal seconds, wherein the nozzle has a first portion in which a liquid ejection side thereof has a smaller opening area than a pressure chamber side thereof, and a second portion which communicates with an ejection side end portion of the first portion, and wherein the ejection pulse has a depressurizing portion for depressurizing the liquid in order to attract a meniscus positioned on the second portion to the first portion, and a pressurizing portion for pressurizing the liquid in order to eject the liquid before the meniscus attracted to the first portion returns to the second portion;

wherein the ejection pulse is set to allow a volume variation of the pressure chamber per unit time caused by the pressurizing portion to be larger than a volume variation of the pressure chamber per unit time caused by the depressurizing portion, and does not have a section, which is subsequent to the pressurizing portion, for suppressing movement of the meniscus after the ejection of the liquid.

2. The liquid ejecting apparatus according to claim 1, wherein the ejection pulse has a maintaining portion for maintaining a state of the piezoelectric element at the time of stopping the generation of the depressurizing portion during the time period from the time of stopping the generation of the depressurizing portion to the time of starting the application of the pressurizing portion.

3. The liquid ejecting apparatus according to claim 1, wherein an impedance of the nozzle is smaller than an impedance of the liquid supply section.

4. The liquid ejecting apparatus according to claim 1, wherein the first portion of the nozzle partitions a space formed in a circular truncated cone shape having a taper angle of 40 degrees or more.

5. The liquid ejecting apparatus according to claim 1, wherein the second portion of the nozzle is formed in a shape of which a sectional area scarcely changes on a plane orthogonal to a nozzle direction.

* * * * *